US009463955B2

(12) United States Patent
Preston

(10) Patent No.: US 9,463,955 B2
(45) Date of Patent: Oct. 11, 2016

(54) ELEVATOR OPERATOR INTERFACE WITH VIRTUAL ACTIVATION

(71) Applicant: ThyssenKrupp Elevator Corporation, Atlanta, GA (US)

(72) Inventor: Robert A. Preston, Collierville, TN (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 306 days.

(21) Appl. No.: 14/180,413

(22) Filed: Feb. 14, 2014

(65) Prior Publication Data

US 2015/0232300 A1 Aug. 20, 2015

(51) Int. Cl.
*B66B 1/34* (2006.01)
*B66B 1/46* (2006.01)
*B66B 3/00* (2006.01)

(52) U.S. Cl.
CPC ..... *B66B 1/468* (2013.01); *B66B 3/002* (2013.01)

(58) Field of Classification Search
CPC ..... B66B 1/468; B66B 3/002
USPC ..... 187/247, 391–396; 340/815.42, 815.79; 359/447, 448, 453, 458
See application file for complete search history.

(56) References Cited

U.S. PATENT DOCUMENTS 4,577,177 A * 3/1986 Marubashi ..... B66B 3/00 187/396
4,716,992 A 1/1988 Kunii
4,880,665 A * 11/1989 Adler ..... G06F 3/043 427/126.1
5,679,934 A * 10/1997 Juntunen ..... B66B 1/462 187/384
6,161,654 A 12/2000 Sirigu et al.
6,161,655 A 12/2000 Lejon et al.
6,281,878 B1 8/2001 Montellese
6,502,668 B1 * 1/2003 Chida ..... H01H 13/70 187/391
6,550,587 B1 * 4/2003 Yuasa ..... B66B 1/462 187/394
6,707,374 B1 3/2004 Zaharia
7,093,692 B2 8/2006 Koura
7,358,956 B2 4/2008 Hinckley (Continued)

FOREIGN PATENT DOCUMENTS

CN 102 701 033 10/2012
EP 0601842 6/1994

(Continued)

OTHER PUBLICATIONS

International Search Report and Written Opinion dated May 20, 2015 for Application No. PCT/US2015/015309.

*Primary Examiner* — Anthony Salata
(74) *Attorney, Agent, or Firm* — Frost Brown Todd

(57) ABSTRACT

An elevator activation system provides virtual activation of one or more buttons by passengers. An optical sensor or time-of-flight camera is positioned near buttons of the elevator and projects an optical curtain over buttons of the elevator. Disturbances in the optical curtain are detected and an exact location of a disturbance in the optical curtain is communicated to a sensor controller which then virtually activates a button correlated to the particular location of the disturbance. The sensor controller communicates with an elevator controller such that the elevator is controlled based on the particular function activated in response to virtual activation of the button. The elevator activation system may further include a user feedback feature configured to signify to a passenger that a button has been virtually activated without physically contacting the button.

20 Claims, 8 Drawing Sheets

(56) References Cited

U.S. PATENT DOCUMENTS

| | | | | |
|---|---|---|---|---|
| 7,562,748 | B2 | 7/2009 | Stranieri et al. | |
| 7,597,177 | B2 | 10/2009 | Oh et al. | |
| 7,711,565 | B1 | 5/2010 | Gazdzinski | |
| 7,823,701 | B2 | 11/2010 | Roussel | |
| 7,992,687 | B2 | 8/2011 | Yumura et al. | |
| 8,020,672 | B2 | 9/2011 | Lin et al. | |
| 8,151,943 | B2 | 4/2012 | de Groot | |
| 8,177,036 | B2 | 5/2012 | Stanley et al. | |
| 8,336,678 | B2 * | 12/2012 | Poutiainen | B66B 1/463 187/395 |
| 8,381,880 | B2 | 2/2013 | Finschi | |
| 8,556,043 | B2 | 10/2013 | Mangini et al. | |
| 8,573,366 | B2 | 11/2013 | Elomaa et al. | |
| 8,584,813 | B2 * | 11/2013 | Talonen | B66B 1/468 187/391 |
| 8,619,061 | B2 | 12/2013 | Yen et al. | |
| 2006/0011419 | A1 | 1/2006 | Chuang | |

FOREIGN PATENT DOCUMENTS

| | | |
|---|---|---|
| JP | 2008 013299 | 1/2008 |
| KR | 101 242 301 | 3/2013 |
| WO | WO 01/93220 | 12/2001 |
| WO | WO 2009/153386 | 12/2009 |
| WO | WO 2012/143612 | 10/2012 |
| WO | WO 2013/176406 | 11/2013 |

* cited by examiner

ELEVATOR OPERATOR INTERFACE WITH VIRTUAL ACTIVATION

BACKGROUND

Elevators typically include a plurality of buttons that may be activated to thereby allow a passenger to designate a particular floor, open or close the door(s) of the elevator, signal for assistance, etc. With many passengers using any given elevator, and selecting one or more of the buttons, the surface of these buttons are touched many times; and if any of these passengers is a carrier of bacteria, viruses, germs, and/or disease, the next passenger may be exposed to the bacteria, viruses, germs, and/or disease by touching the same button(s). In the field of elevators, it is therefore desirable to provide devices that can minimize the spread of bacteria, viruses, germs, and/or disease. While there may be devices and method that attempt to accomplish this, it is believed that no one prior to the inventor(s) has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements.

Figure 1:
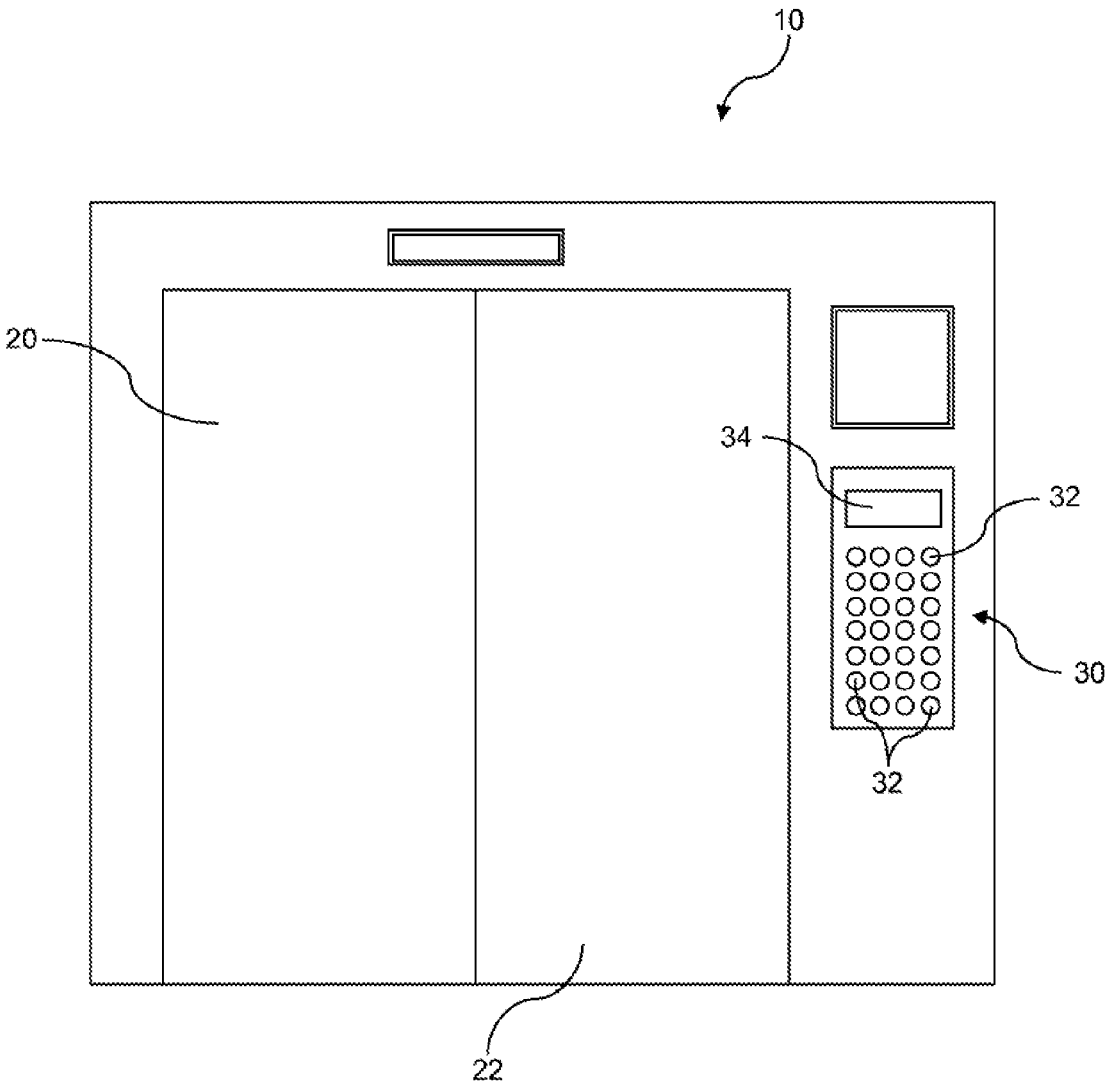
FIG. 1 (PRIOR ART)
FIG. 1 depicts an elevational view of an elevator.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

FIG. 1 shows a portion of an elevator (10). In some versions FIG. 1 represents an interior of elevator (10), while in other versions FIG. 1 represents an exterior of elevator (10). Elevator (10) includes a pair of doors (20, 22) and an operating panel (30). Doors (20, 22) are configured to move between an open position and a closed position to thereby allow or prevent passengers to enter and/or exit elevator (10). Operating panel (30) comprise a plurality of buttons (32) and a user feedback feature (34). Each button (32) of plurality of buttons (32) is operable to be activated by a passenger. For instance, a passenger may activate a particular button (32) of the present example by depressing the particular button (32). As will be discussed in more detail below, operating panel (30) is in communication with a controller (40), or elevator controller. Activation of buttons (32) is communicated to controller (40) to thereby control elevator (10). For instance, and among other functions, a passenger may select a particular button (32) that correlates to a particular floor, thus controller (40) would cause elevator (10) to be driven to the selected floor; a passenger may alternatively or additionally select a particular button (32) to thereby communicate to controller (40) to open or close doors (20, 22) more expeditiously; or a passenger may alternatively or additionally select a particular button (32) to thereby communicate to controller (40) to signal for assistance.

User feedback feature (34) is operable to signal to a passenger that a particular button (32) has been activated. For instance, user feedback feature (34) may visually or audibly alert a user as soon as a particular button (32) has been activated. User feedback feature (34) may alternatively or additionally signal to a passenger which functions are to be performed by elevator (10). For instance, user feedback feature (34) may visually or audibly signify to the passenger the particular floor number elevator (10) is traveling to; that doors (20, 22) are opening or closing; or that assistance has been called. User feedback feature (34) may comprise a visual display. For instance, user feedback feature (34) may comprise a liquid crystal display (LCD), a light-emitting diode (LED) display, etc. User feedback feature (34) may alternatively or additionally comprise an audible device. For instance, user feedback feature (34) may comprise a flat panel speaker, etc. In some versions user feedback feature (34) may comprise haptic feedback, e.g. causing the selected button (32) to vibrate once depressed to indicate a selection has been made and received. In other versions, feedback feature (34) can be connected with a vibration member in the floor or underfoot to cause that vibration feature to vibrate in response to receiving a selection or input. In view of the teachings herein, other ways to use or configure user feedback feature (34) will be apparent to those of ordinary skill in the art.

During operation, many different passengers activate buttons (32), thus it should be understood that buttons (32) may become contaminated by bacteria, viruses, germs, and/or disease. Thus, in some versions of elevator (10), it may be desirable to provide a system to eliminate the need for passengers to physically contact buttons (32) to activate buttons (32)—in other words virtual activation of buttons (32). Such a system would thereby minimize possible contamination of buttons (32) and/or exposing passengers to bacteria, viruses, germs, and/or disease that may already be on the buttons themselves.

An exemplary such system, system (100), is shown in FIGS. 2-6B. System (100) comprises operating panel (30)—including buttons (32) and user feedback feature (34)—an optical sensor (102), and a sensor controller (106). In some examples, optical sensor (102) can be a near infrared optical detector style sensor. In the present example, optical sensor (102) comprises a transmitter or emitter (202) that emits infrared or near infrared light, and optical sensor (102) also comprises a receiver (204) that detects reflection of the emitted light. In this configuration, optical sensor (102) is a single unit that does not require the transmitter or emitter (202) component to be separate from the receiver (204) component. In some versions multiple optical sensors (102) can be used together, e.g. to cover greater area or provide redundancy.

In some versions, a time-of-flight camera (302) is used in place of or in addition to optical sensor (102). In such versions using a time-of-flight camera (302), camera (302) comprises an illumination unit (304) that emits a light pulse—e.g. intensity-modulated light in the near-infrared range, a lens (306) that receives and projects reflected light from the light pulse, and an image sensor (308) that receives the reflected projected by the lens (306). The image sensor (308) can operate with sensor controller (106) to correlate the emitted and received light to determine the distance of the illuminated object that caused the emitted light to be reflected. Both optical sensor (102) and time-of-flight camera (302) can be considered different types of optical sensing devices. Other sensor types will be apparent to those of ordinary skill in the art in view of the teachings herein.

Figure 5:
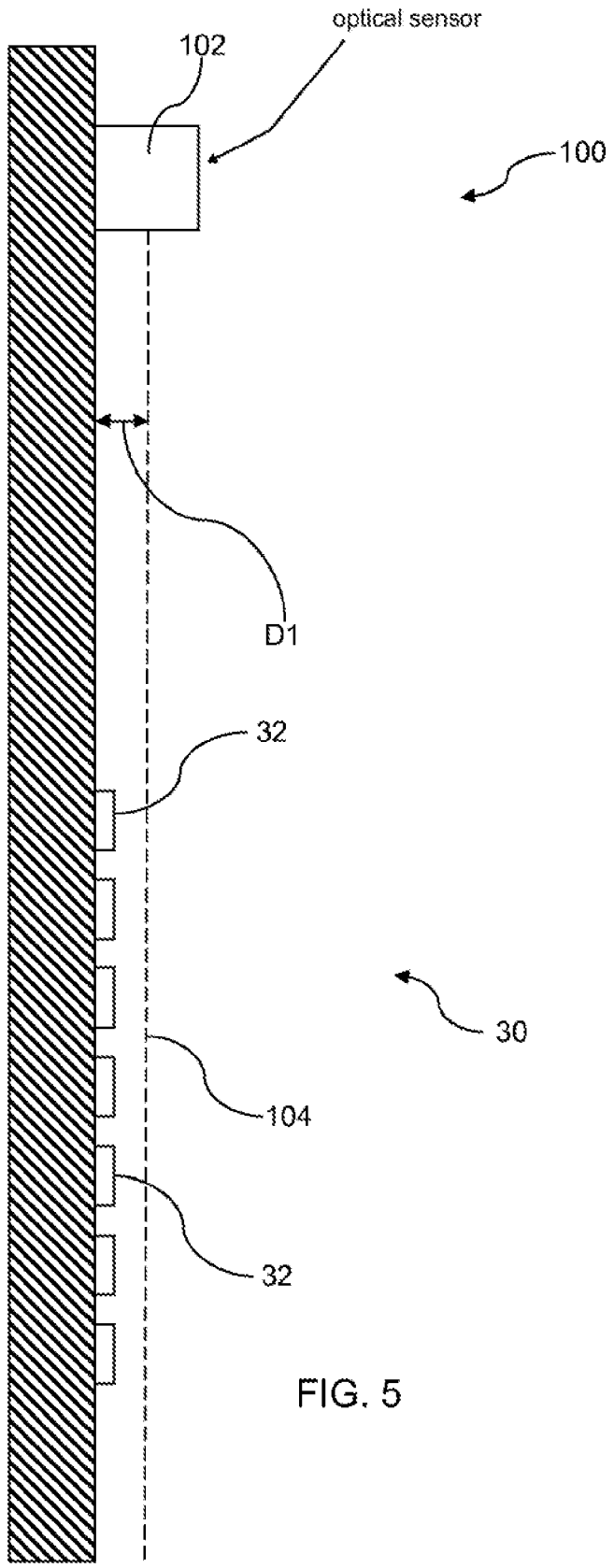
FIG. 5 depicts a cross-sectional view of the sensing mechanism of FIG. 2.

In the present examples, optical sensor (102) or time-of-flight camera (302) is configured to project, transmit, emit, or illuminate an area creating an optical curtain (104) in a triangular array (although other array shapes can be used) a distance (D1) from a face of operating panel (30) and generally parallel with the face of operating panel (30) as best seen in FIG. 5. The triangular array of optical curtain (104) extends outwardly from optical sensor (102) and widens as one moves further from optical sensor (102) or time-of-flight camera (302). In some instances optical curtain (104) is generally two dimensional, creating an area that covers a generally corresponding area taken up by buttons (32). In still other versions, optical curtain (104) is a three dimensional zone that can extend in depth from buttons (32) to some distance (D1) spaced from buttons (32).

Figure 2:
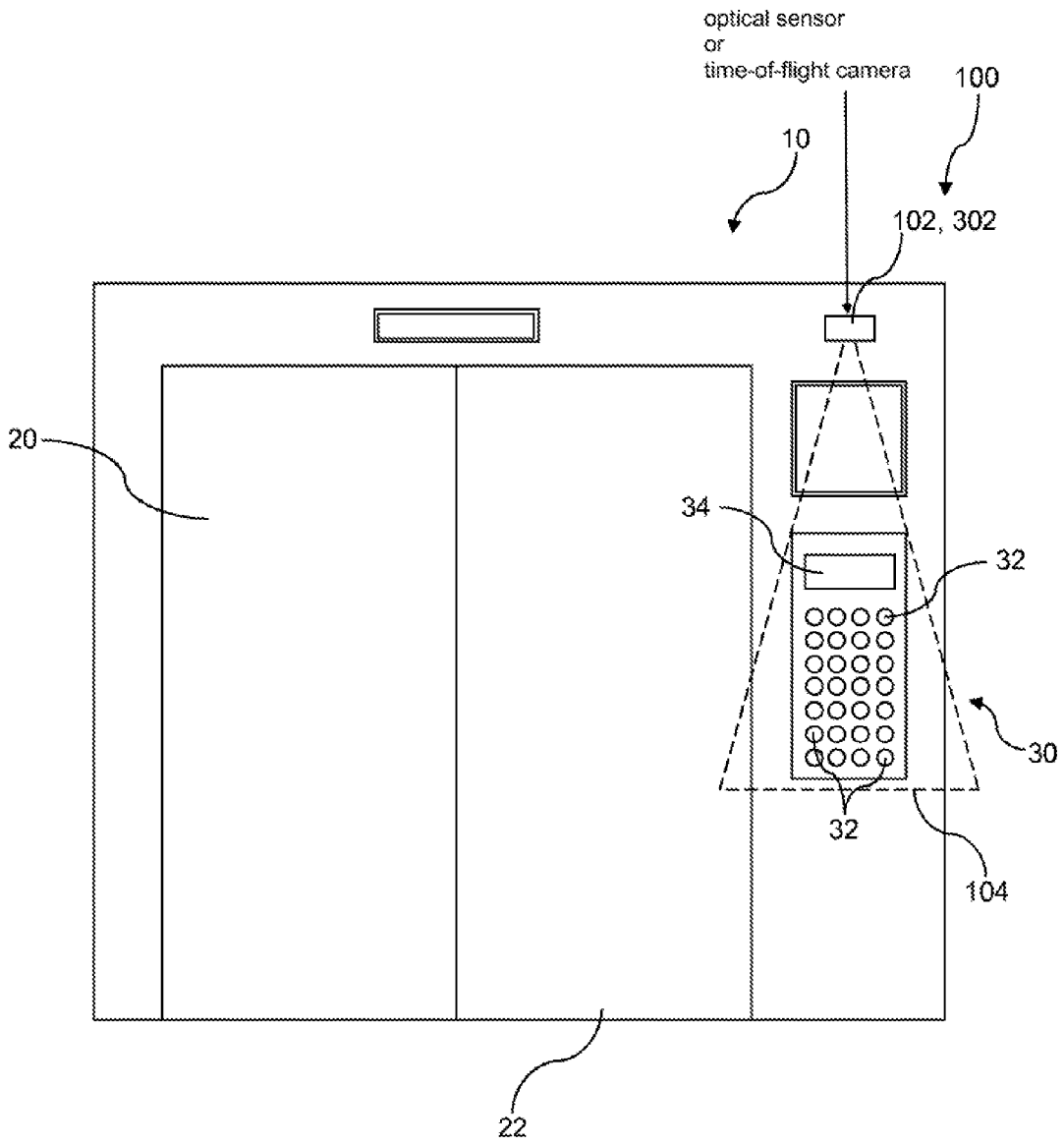
FIG. 2 depicts an elevational view of the elevator having a sensing mechanism in a first orientation.
Figure 3:
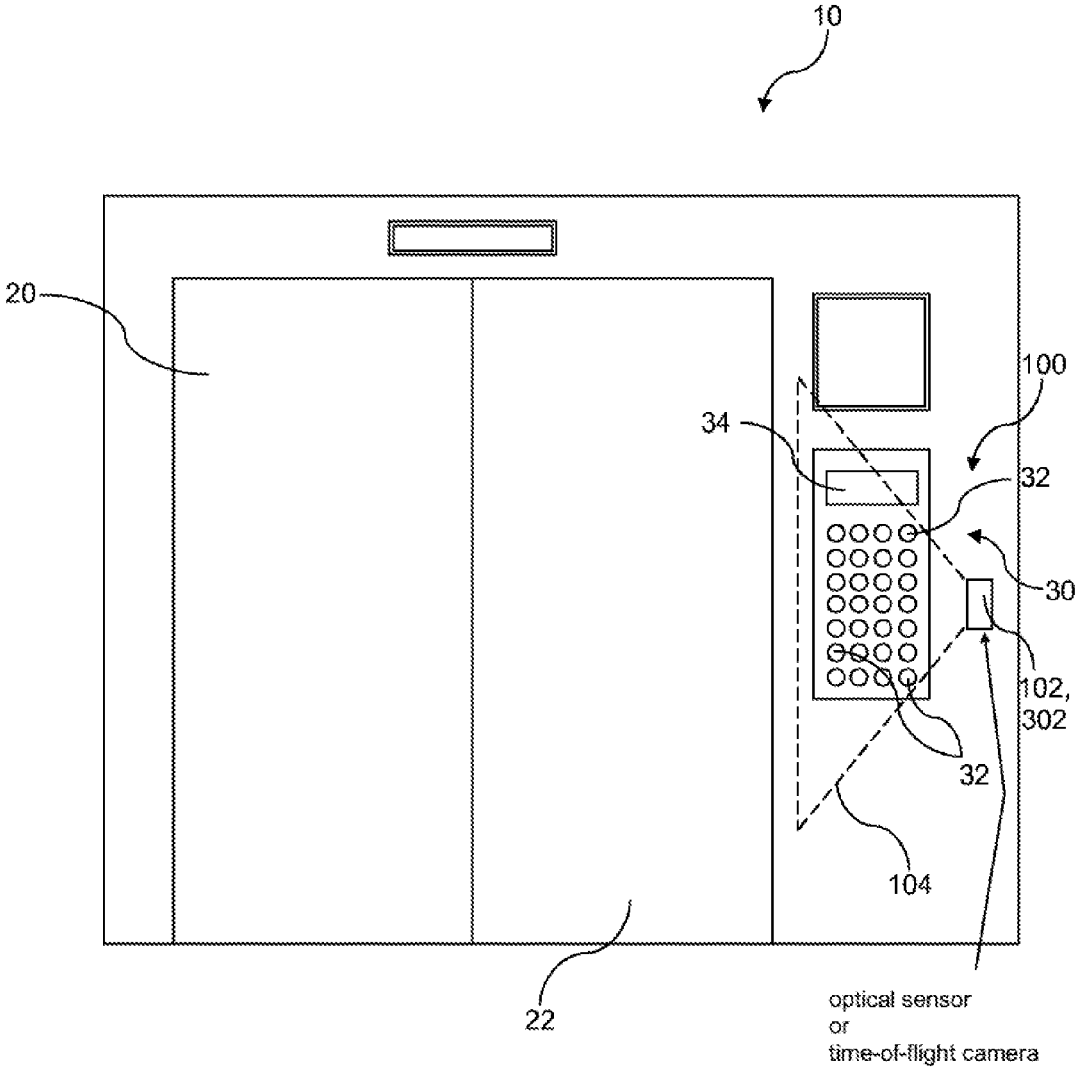
FIG. 3 depicts an elevational view of the elevator with the sensing mechanism of FIG. 2 in a second orientation.
Figure 4:
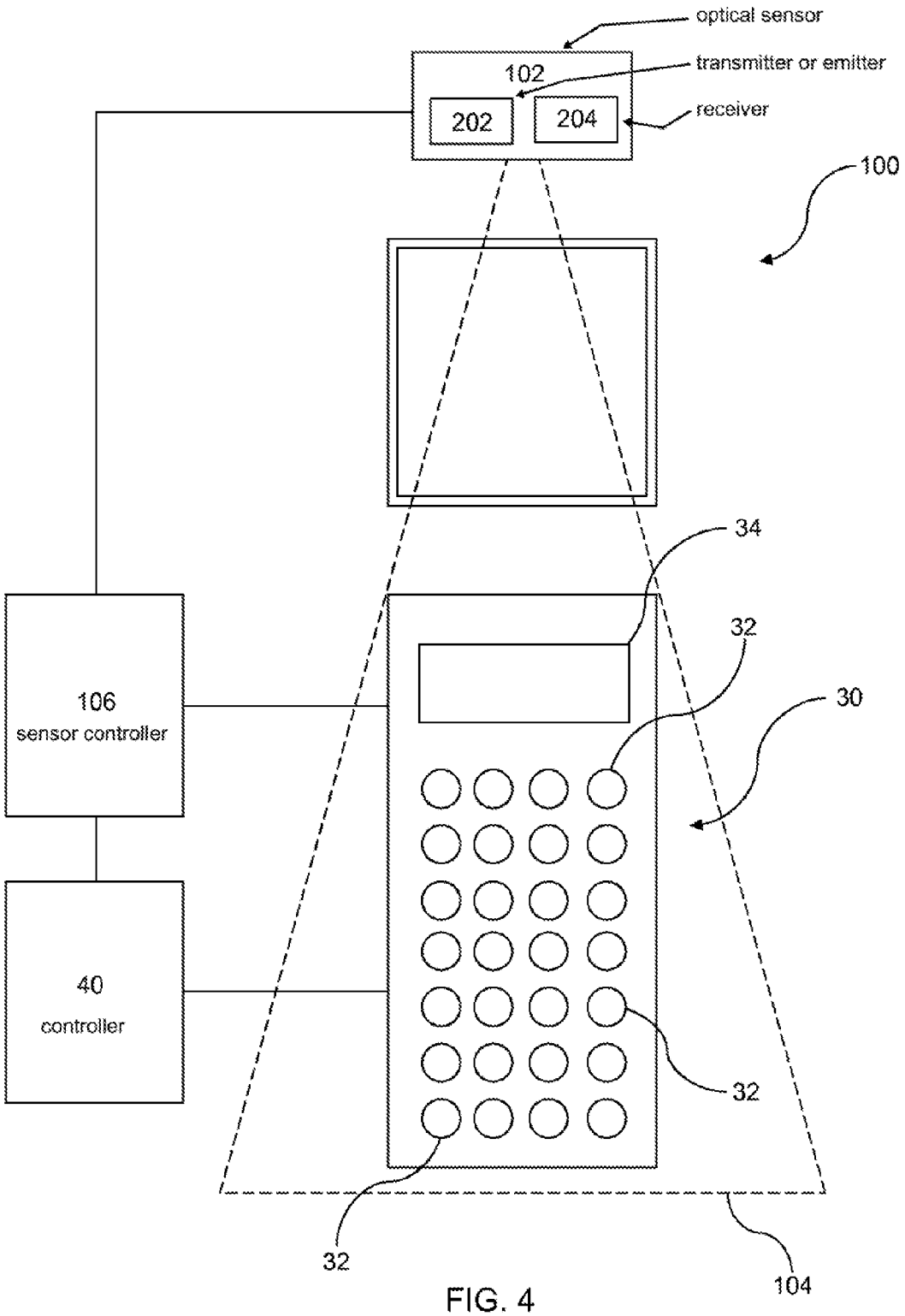
FIG. 4 depicts a schematic view of an exemplary sensing mechanism of FIG. 2 using and optical sensor.

As best seen in FIGS. 2-4, optical curtain (104) covers the area of operating panel (30) in which buttons (32) are located. It should therefore be understood that a single optical sensor (102) or time-of-flight camera (302) is operable to project an optical curtain (104) over one or more buttons (32). Furthermore, as illustrated in the present example, buttons (32) can be positioned along multiple horizontal and vertical axes within operating panel (30), and a single optical sensor (102) or time-of-flight camera (302) projects optical curtain (104) that is configured as an array that covers buttons (32) that are arranged along multiple horizontal and vertical axes of operating panel (30). It should further be understood that optical sensor (102) or time-of-flight camera (302) may be oriented and positioned at any appropriate location within elevator (10) so long as optical curtain (104) is projected such that optical curtain (104) covers the area of operating panel (30) in which buttons (32) are located. For instance, as shown in FIGS. 2 and 3, optical sensor (102) or time-of-flight camera (302) may be located above operating panel (30) or on a side of operating panel (30) and can be oriented such that optical curtain (104) is projected vertically or horizontally. It should be understood that optical sensor (102) or time-of-flight camera (302) may project optical curtain (104) in any appropriate pattern. By way of example only, and not limitation, in the present example, optical curtain (104) comprises a triangular array. In other versions having larger panels (30) for instance, multiple optical sensors (102) may be used to provide more resolution and the shape of the resulting optical curtain (104) from the multiple optical sensors (102) may be that of an hourglass or trapezoid. In versions using time-of-flight camera (302), greater resolution and distance capability may be achieved using a single time-of-flight camera (302) compared to a single optical sensor (102), yet those of ordinary skill in the art will understand, in view of the teachings here, that multiple time-of-flight cameras (302) can be used in some instances.

As shown in FIG. 4, optical sensor (102) or time-of-flight camera (302) is in communication with sensor controller (106). Sensor controller (106) is in communication with both operating panel (30) and controller (40). Optical sensor (102) or time-of-flight camera (302) is operable to sense a location of disturbance within the field of optical curtain (104) as objects pass through optical curtain (104). Optical sensor (102) or time-of-flight camera (302) is configured to detect the precise location of the disturbance within the field of optical curtain (104). For example, the receiver (204) within optical sensor (102) detects reflections of the light emitted by the transmitter (202) within optical sensor (102). In the case of a time-of-flight camera (302), image sensor (308) receives the projected reflected light from lens (306) and based on the known emitted light by illumination unit (304) compared with the received reflected light, the precise location of the disturbance causing the reflection of light within the field of optical curtain (104) is determined. The reflections of light are caused by an object, such as a user's finger, penetrating or breaking the plane of optical curtain (104). Based on the direction from which the reflection was detected, and the intensity of the reflection detected, optical sensor (102) or time-of-flight camera (302) can determine the precise location of the disturbance within the field of optical curtain (104). In this way, the location of the disturbance within optical curtain (104) is also the location within optical curtain (104) from which reflected light was detected by the receiver (204) component of optical sensor (102) or image sensor (308) of time-of-flight camera (302).

Once the precise location of the disturbance within optical field (104) has been determined by optical sensor (102) or time-of-flight camera (302), this precise location is communicated to sensor controller (106). Sensor controller (106) is configured to correlate the precise location of the disturbance within optical curtain (104) with a particular button (32) located longitudinally from, or in-line with, or adjacent to, the disturbance. In this way, sensor controller (106) is configured with the information defining the shape and size of optical curtain (104) and how that is positioned relative to buttons (32) of the operating panel (30). In this way, a location of each of the plurality of buttons (32) correlates to a predetermined location near, proximate, or adjacent optical curtain (104). Thus a disturbance at that predetermined location within optical curtain (104) is associated with a particular button (32) within operating panel (30). With this information and coupled with the data from optical sensor (102) or time-of-flight camera (302) regarding the precise location of the disturbance within optical curtain (104), sensor controller (106) can make the above correlation between the disturbance location and button (32) and then virtually activate a particular button (32). This information is then communicated to controller (40) to drive functions of elevator (10). Thus, it should be understood that a passenger can virtually activate buttons (32) of operating panel (30) to thereby operate elevator (10) without having to physically contact buttons (32). It should be appreciated that optical sensor (102) or time-of-flight camera (302) is operable to sense disturbances along multiple axes within optical curtain (104), and that buttons (32) may positioned at any appropriate location and in any appropriate pattern within optical sensor (102). Furthermore, in versions using time-of-flight camera (302), camera (302) can resolve an image of the object causing the disturbance and further provide or communicate that image information to sensor controller (106). In some instances this information may be used to confirm that a target button (32) was intended to be selected or activated, rather than mere unintended disturbance of optical curtain (104).

As passengers enter and exit elevator (10), objects such as coats, purses, etc. may inadvertently disturb optical curtain (104). It should be understood that optical sensor (102) and/or time-of-flight camera (302) may be configured to recognize inadvertent disturbances of optical curtain (104) to thereby prevent inadvertent activation of buttons (32). For instance, where optical curtain (104) comprises a three dimensional zone, optical sensor (102) or time-of-flight camera (302) can be configured to accept activations by disturbances in the three dimensional zone where the disturbances were caused by a shape that generally matches that of a passenger's finger. Furthermore, disturbances caused by shapes not typical of an object used to depress a button (32) can be ignored or discounted such that activation does not occur even though a disturbance may be detected. In some versions, sensor controller (106) has a size rejection routine running to accomplish this verification function.

Figure 6A:
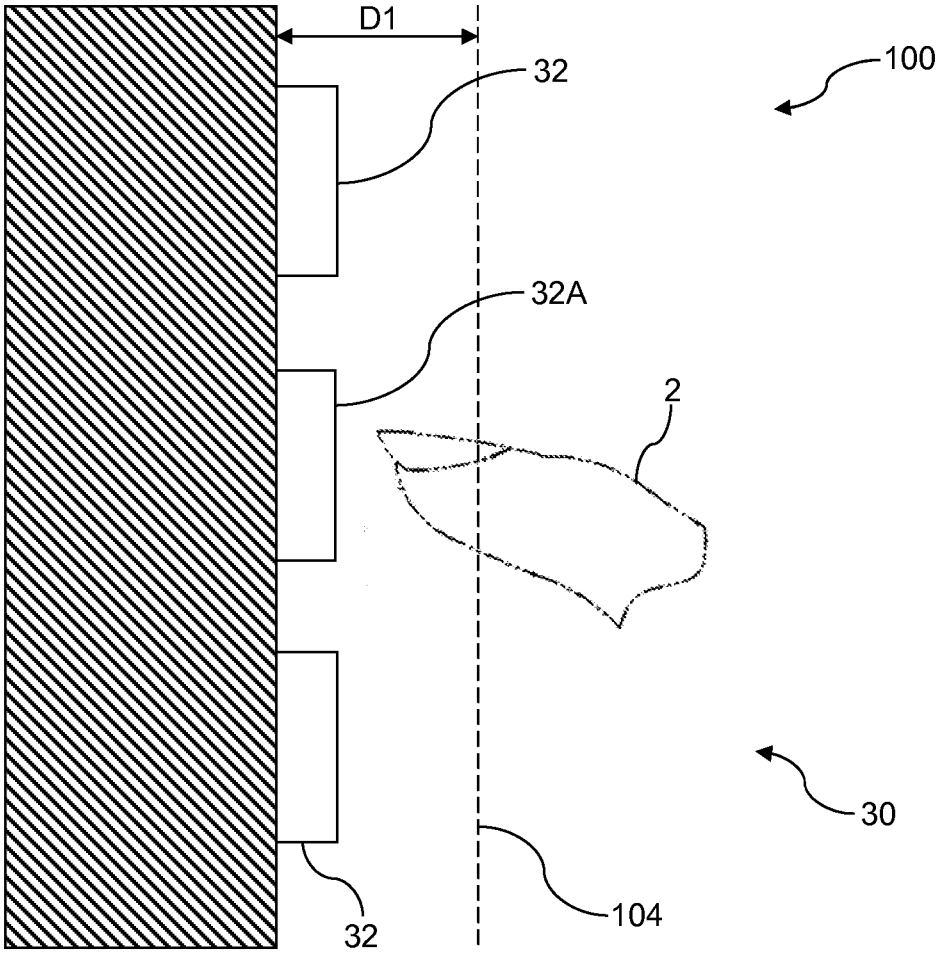
FIG. 6A depicts a detailed cross-sectional view of the sensing mechanism of FIG. 2 with a user's finger passing through an optical field of the sensing mechanism.
Figure 6B:
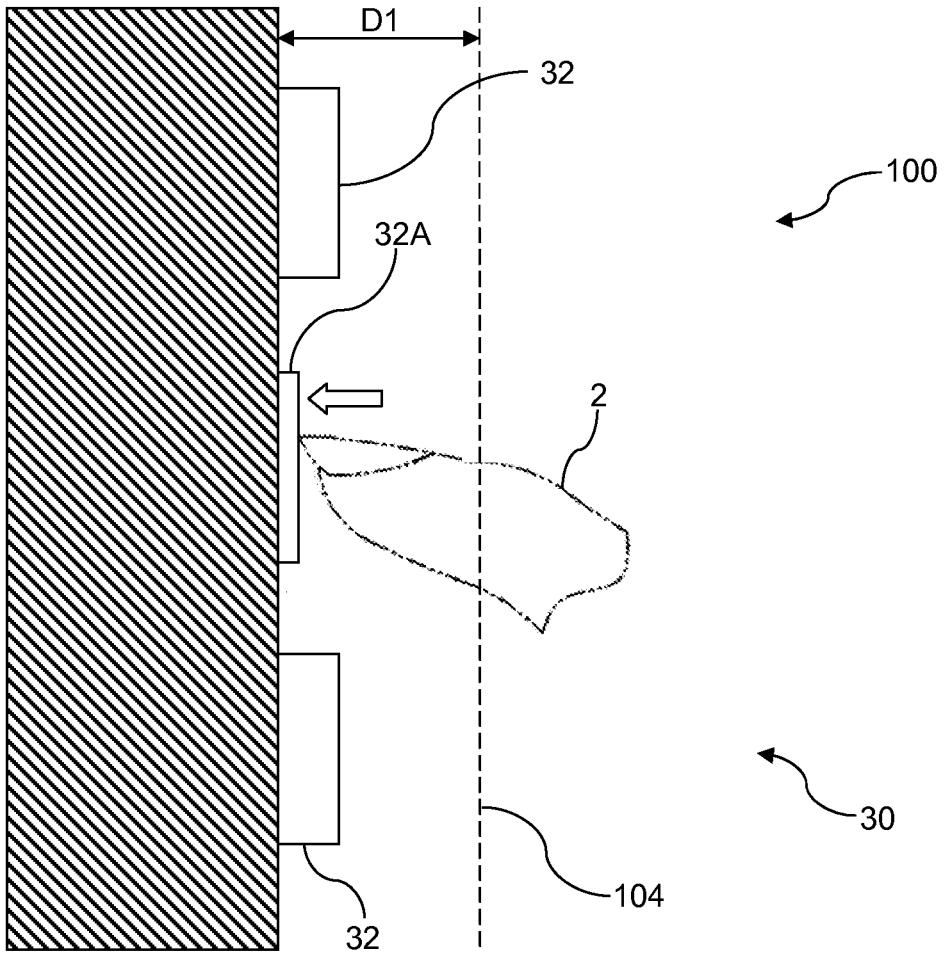
FIG. 6B depicts a detailed cross-sectional view of the sensing mechanism of FIG. 2 with the user's finger depressing the button of the elevator.
Figure 7:
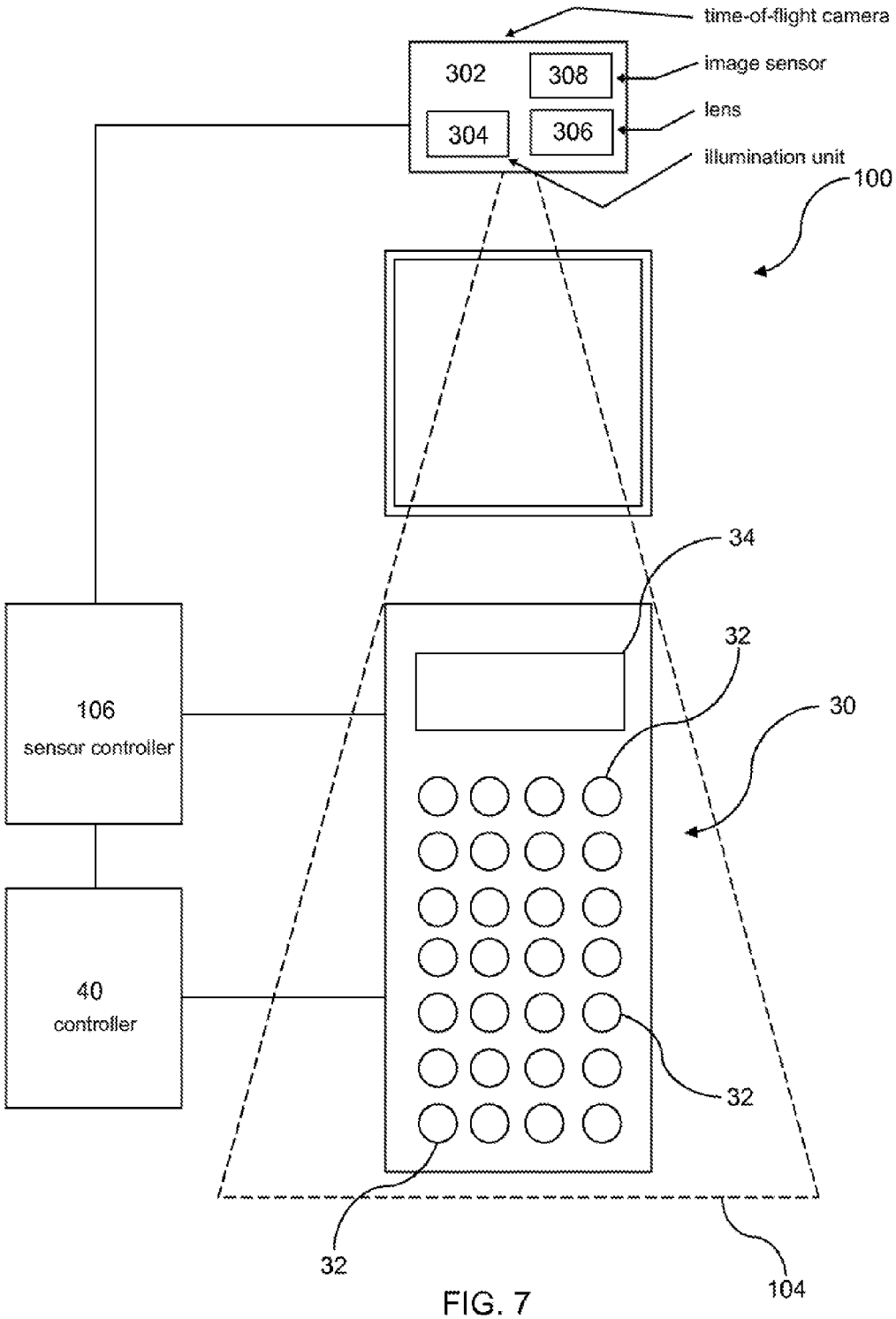
FIG. 7 depicts a schematic view of another exemplary sensing mechanism of FIG. 2 using a time-of-flight camera.

FIGS. 6A-6B show the steps of virtually activating buttons (32) using system (100). As shown in FIG. 6A, a passenger moves her finger (2) toward a particular button (32A). Once finger (2) passes through optical curtain (104), optical sensor (102) or time-of-flight camera (302) senses this disturbance and communicates the exact location of the disturbance to sensor controller (106). Sensor controller (106) correlates this disturbance with the location of button (32A) and signals to controller (40) that button (32A) has been virtually activated. At this point, user feedback feature (34) would signal to the passenger that button (32A) has been activated and controller (40) would cause elevator (10) to perform the function represented by button (32A). The passenger may then remove her finger (2) from optical curtain (104). If, however, the passenger desires to physically activate button (32A), the passenger may continue to move her finger (2) toward button (32A) until button (32A) has been physically depressed as shown in FIG. 6B. It should be understood that this physical activation of button (32A) may be configured to override the activation caused by disturbance within optical curtain (104) if the virtual activation and physical activation are inconsistent. For instance, if the physical activation of button (32A) occurs within a predetermined amount of time from when the non-contact activation occurred via disturbing optical curtain (104). Likewise, where the contact activation and non-contact activation of button (32A) are consistent, system (100) would be configured to only register a single activation such that any duplicative activation would not alter the way elevator (10) is controlled.

It should be understood that, although system (100) discussed above was used in conjunction with buttons (32), system (100) may be used with merely a display disposed or projected onto a surface of elevator (10). For instance, a decal or projected image of representative buttons may be on the surface of elevator (10) and system (100) may be configured to recognize disturbances of optical curtain (104) which correlate to the representative buttons of the decal or projected image. For instance, instead of physical buttons (32), non-depressible targets can be located adjacent to optical curtain (104) and optical sensor (102) or time-of-flight camera (302) can be configured such that each particular target is associated with a function or input to elevator (10), e.g., a target for each floor serviced by elevator (10). Also, optical curtain (104) and optical sensor (102) or time-of-flight camera (302) can be configured to be disable if desired, for instance in emergency situations, thereby leaving the ability to physically activate buttons (32) by direct contact.

Although not required in all versions, in some versions sensor controller (106) is positioned within optical sensor (102) or time-of-flight camera (302) such that optical sensor (102) and sensor controller (106) are a single unit, or in the case of using a time-of-flight camera (302), camera (302) and sensor controller (106) are a single unit. Because optical sensor (102) or time-of-flight camera (302) is secured to a surface of elevator (10), it should be understood that existing elevators may be easily retrofit with system (100). To further make retrofitting more efficient, it should be understood that sensor controller (106) may be in wireless communication with controller (40) where capable, although other forms of communication, e.g. serial communication may be used. In such retrofit versions, system (100) can be used with an existing panel of buttons from the earlier installation. In some retrofit instances a virtual operating panel can be added—for instance projection of an image of buttons or using decal or laminated targets—and in such instances this could be done to replace or augment an existing panel of button form the earlier installation. By way of example only and not limitation, in a retrofit application the existing panel may be maintained and a second virtual panel could be added—for instance on the other side of the elevator doors such that there was a panel on each side of the elevator doors for convenience.

Sensor controller (106), controller (40), and optical sensor (102) or time-of-flight camera (302) each can comprise a processor, memory, and logic such that they are capable of executing the steps and functions described above. For instance, sensor controller (106) in some versions comprises a processor, memory, and logic that allows sensor controller (106) to correlate the location of a disturbance in optical curtain (104) with a particular location of a button (32), activate the particular button (32), and transmit this data to controller (40), which contains another processor, memory, and logic that allows controller to drive functions of elevator (10). Still yet, processor, memory, and logic of sensor controller (106) allows sensor controller (106) to control operation of optical sensor (102) or time-of-flight camera (302); for instance, by turning on and off, or enabling and disabling, optical sensor (102) or time-of-flight camera (302). In view of the teachings herein, other ways to configure sensor controller (106), controller (40), and optical sensor (102) or time-of-flight camera (302) will be apparent to those of ordinary skill in the art.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

I claim:

1. An elevator activation system, wherein the elevator activation system comprises:

a. a plurality of buttons positioned on an operating panel and configured to be activated by physical contact, wherein the plurality of buttons are positioned along multiple horizontal and vertical axes;

b. an optical sensing device, wherein the optical sensing device is configured to project an optical curtain, wherein the optical curtain comprises an array that covers the plurality of buttons that are positioned along the multiple horizontal and vertical axes of the operating panel, wherein the optical sensing device is configured to detect a disturbance in the optical curtain at a distance away from the operating panel; and c. a sensor controller, wherein the sensor controller is configured to virtually activate at least one button of the plurality of buttons in response to the disturbance detected in the optical curtain, wherein virtual activation of the at least one button of the plurality of buttons comprises activation of the at least one button before physically contacting the operating panel.

2. The system of claim 1, wherein the elevator activation system further comprises a user feedback feature configured to signal to a user that one of the plurality of buttons has been activated before the user physically contacts the one of the plurality of buttons.

3. The system of claim 1, wherein a location of each button of the plurality of buttons correlates to a predetermined location within the optical curtain.

4. The system of claim 1, wherein activation of one of the plurality of buttons is configured as an input to an elevator controller to drive a particular function of an elevator.

5. The system of claim 1, wherein the plurality of buttons is located on the interior of an elevator.

6. The system of claim 1, wherein the optical sensing device projects the optical curtain substantially parallel to the plurality of buttons.

7. The system of claim 1, wherein the optical sensing device projects the optical curtain a predetermined distance from the plurality of buttons.

8. The system of claim 1, wherein optical sensing device projects the optical curtain in a triangular array.

9. The system of claim 1, wherein the plurality of buttons are depressible for activation.

10. The system of claim 1, wherein the physical activation of one of the plurality of buttons overrides virtual activation of another one of the plurality of buttons.

11. The system of claim 1, wherein a portion of the plurality of buttons corresponds to floor levels.

12. The system of claim 1, wherein the optical sensing device comprises an optical sensor.

13. The system of claim 1, wherein the optical sensing device comprises a time-of-flight camera.

14. An elevator system, wherein the elevator system comprises:

a. an elevator controller;

b. a single optical sensor, wherein the optical sensor comprises:

(i) a transmitter for transmitting an optical curtain over an area covering multiple horizontal and vertical axes, wherein the optical curtain is spaced a predetermined distance from a plurality of buttons configured to be activated by physical contact, and (ii) a receiver for detecting disturbances in the optical curtain along the multiple horizontal and vertical axes within the area covered by the optical curtain; and c. a sensor controller, wherein the sensor controller is configured to virtually activate a function of the elevator system in response to a detection of a disturbance in the optical curtain at a predetermined location.

15. The elevator system of claim 14, wherein the disturbance in the optical curtain comprises detected reflection of light comprising the optical curtain, wherein the reflection is detected at the receiver of the optical sensor.

16. A method for controlling an elevator comprising the steps of:

a. projecting an optical curtain from an optical sensing device, wherein the optical curtain is projected over a plurality of physically activatable buttons oriented along multiple axes within an operating panel;

b. sensing at the optical sensing device, a disturbance in the optical curtain from a precise location within the optical curtain, wherein the disturbance in the optical curtain is sensed at a predetermined distance away from the plurality of physically activatable buttons such that the disturbance is sensed before physically contacting the operating panel, c. virtually activating a first button of the plurality of physically activatable buttons in response to the optical sensing device sensing the disturbance at the precise location within the optical curtain; and d. controlling a predetermined function of the elevator in response to virtual activation of the first button.

17. The method of claim 16, wherein the act of virtually activating the first button is performed by a sensor controller.

18. The method of claim 15, further comprising the step of physically activating the first button.

19. The method of claim 18, wherein the step of physically activating the first button is disregarded as duplicative of virtually activating the first button.

20. The method of claim 15, further comprising the step of physically activating a second button of the plurality of physically activatable buttons and overriding virtually activating the first button in response to physically activating the second button.

* * * * *